United States Patent [19]

Lindley

[11] 4,309,057

[45] Jan. 5, 1982

[54] FOLDABLE CHAIR AND ASSOCIATED CUSHION ADJUSTING APPARATUS

[76] Inventor: John M. Lindley, P.O. Box 1464, Oakland, Calif. 94604

[21] Appl. No.: 141,388

[22] Filed: Apr. 18, 1980

[51] Int. Cl.[3] ..... A47C 1/12; A47C 3/20

[52] U.S. Cl. ..... 297/58; 297/338; 297/239

[58] Field of Search ..... 297/338, 337, 339, 58, 297/239, 284, 452; 254/264; 74/501 R

[56] References Cited

U.S. PATENT DOCUMENTS

| | | | |
|---|---|---|---|
| 3,250,569 | 5/1966 | Gaffney | 297/339 X |
| 3,802,734 | 4/1974 | Lindley | 297/338 X |

*Primary Examiner*—Peter P. Nerbun

*Attorney, Agent, or Firm*—Edward Brosler; Merwyn Brosler

[57] ABSTRACT

In association with a foldable chair having retractable back and seat cushions for storage purposes, means are provided for elevating the cushions for use, after the chairs have been unfolded and arranged in rows.

9 Claims, 14 Drawing Figures

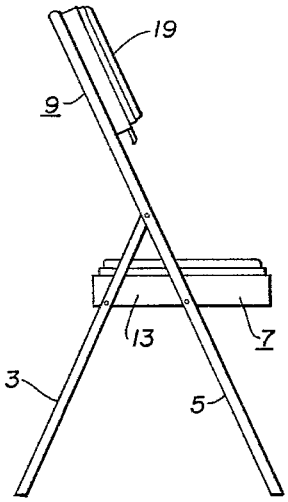
Fig. 1
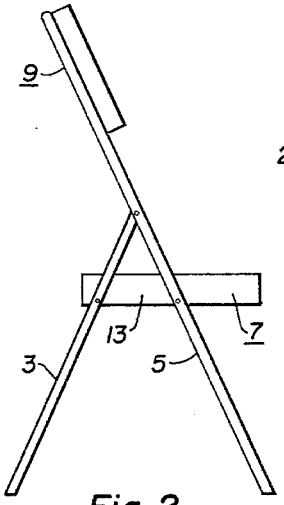
Fig. 2
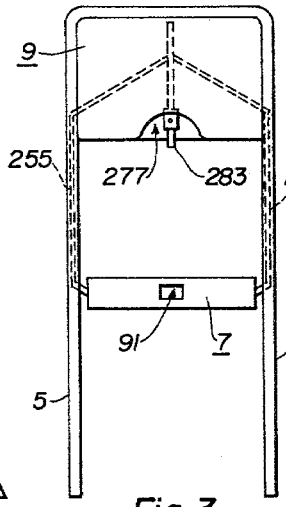
Fig. 3
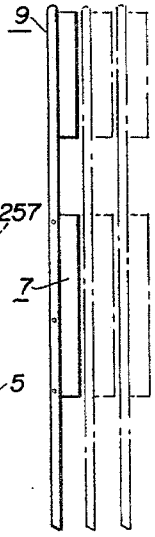
Fig. 4
Fig. 11
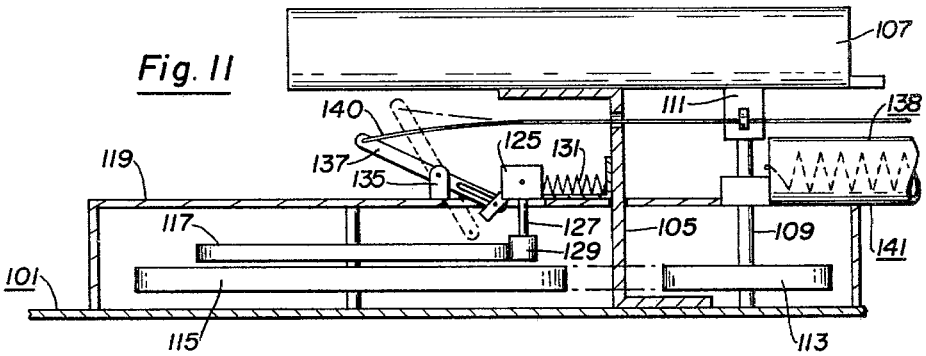
Fig. 10
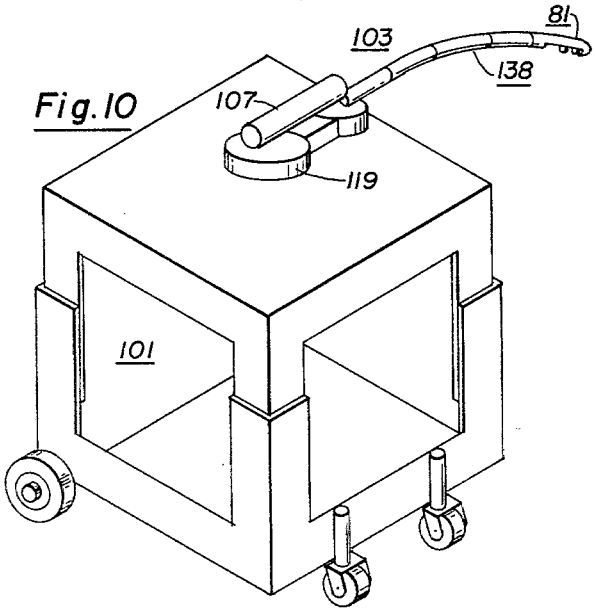
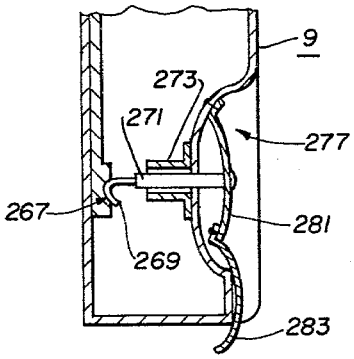
Fig. 14

FOLDABLE CHAIR AND ASSOCIATED CUSHION ADJUSTING APPARATUS

THE INVENTION

The invention relates to foldable chairs and more particularly foldable chairs having retractable back and seat cushions to conserve space when such chairs are folded and stacked for storage.

Such chairs are normally set up and arranged in rows, usually on a temporary basis, and following such an arrangement of chairs in rows, the step remains of elevating the cushions for use by individuals who are to occupy such chairs. The present invention involves apparatus for accomplishing this last step of elevating the cushions following the arrangement of such chairs in rows.

Among the objects of my invention are:

(1) To provide a novel and improved means for elevating the cushions of a foldable chair having retractable cushions;

(2) To provide a novel and improved means for accomplishing the release of such cushions through a very simple and quick operation;

(3) To provide means for elevating the cushions of foldable chairs, one after another in quick succession, after such chairs are arranged in rows.

Additional objects of my invention will be brought out in the following description of a preferred embodiment of the same taken in conjunction with the accompanying drawings wherein:

FIG. 1 is a side view in elevation of a foldable chair of the type to which the present invention is applicable and showing the seat and back rest cushions elevated;

FIG. 2 is a comparable view with the cushions retracted;

FIG. 3 is a front view in elevation of the foldable chair of FIGS. 1 and 2;

FIG. 4 is a side view in elevation of a plurality of such chairs as taken from storage in preparation for unfolding and arranging in rows for use;

FIG. 10 is a three dimensional view of apparatus associated with the tool for controlling operation of the tool;

FIG. 11 is a view, partly in section, of a portion of the control apparatus of FIG. 10;

FIG. 14 is a fragmentary view in section of a feature involving simultaneous control of the back rest cushion from the operation of the seat cushion.

Figure 5:
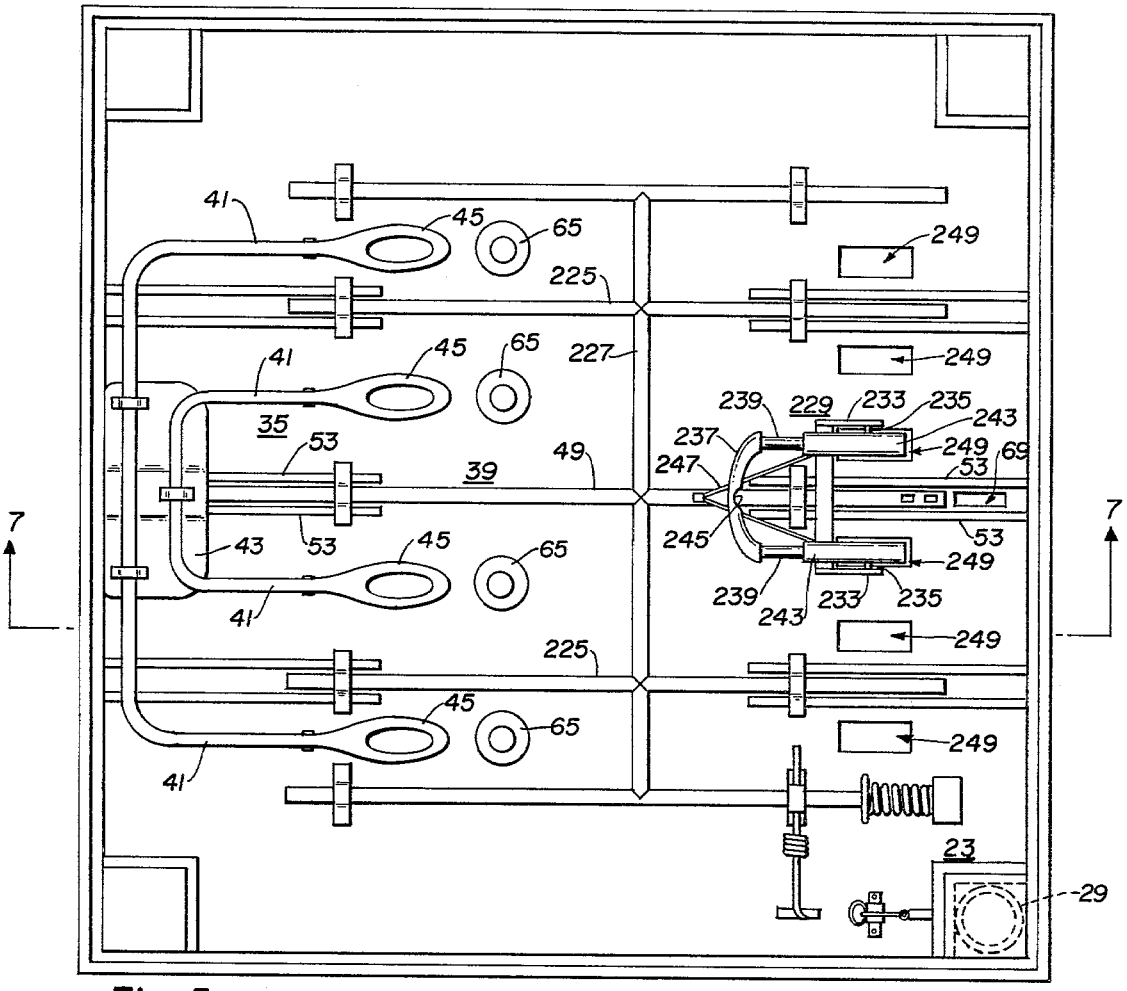
FIG. 5 is a plan view within the seat frame.
Figure 6:
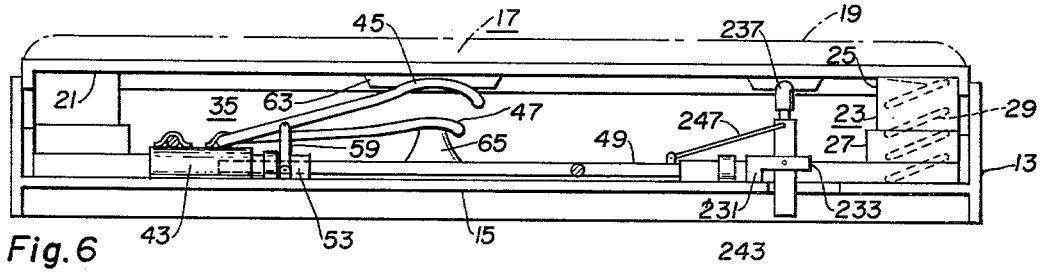
FIG. 6 is a view in section through the seat assembly with the seat cushion in elevated position.
Figure 7:
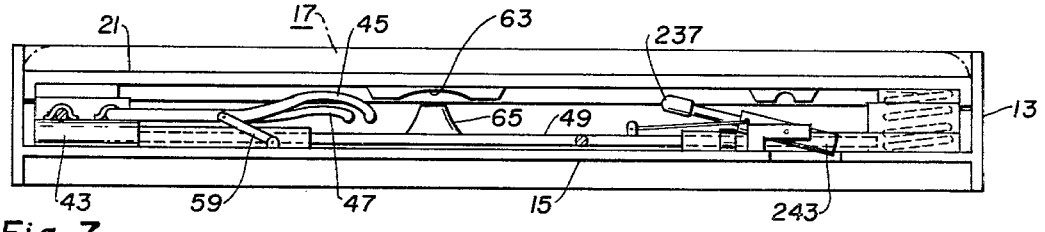
FIG. 7 is a comparable view depicting the seat cushion in retracted position.
Figure 12:
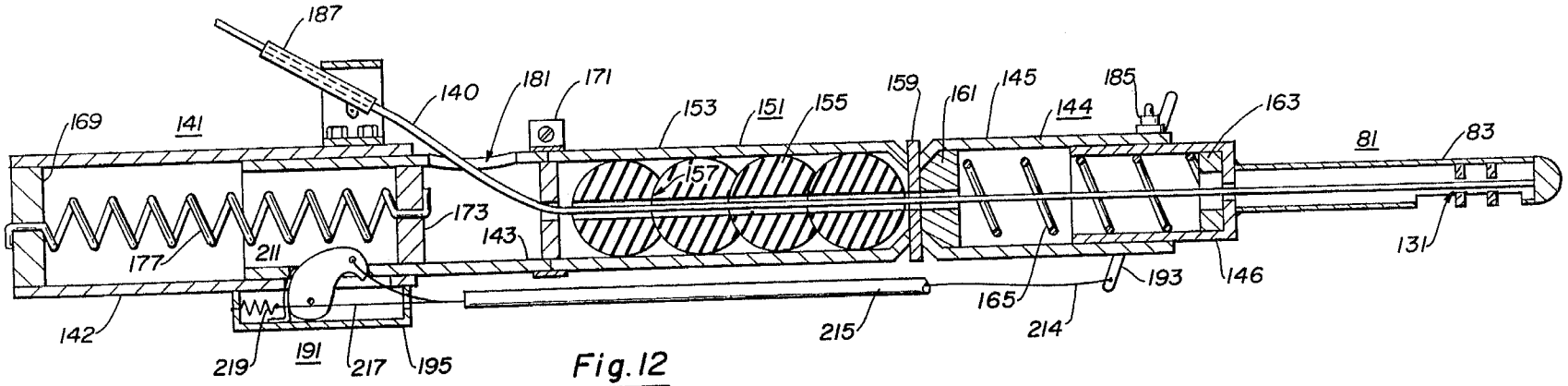
FIG. 12 is a view in section of another portion of the control apparatus of FIG. 10.
Figure 8:
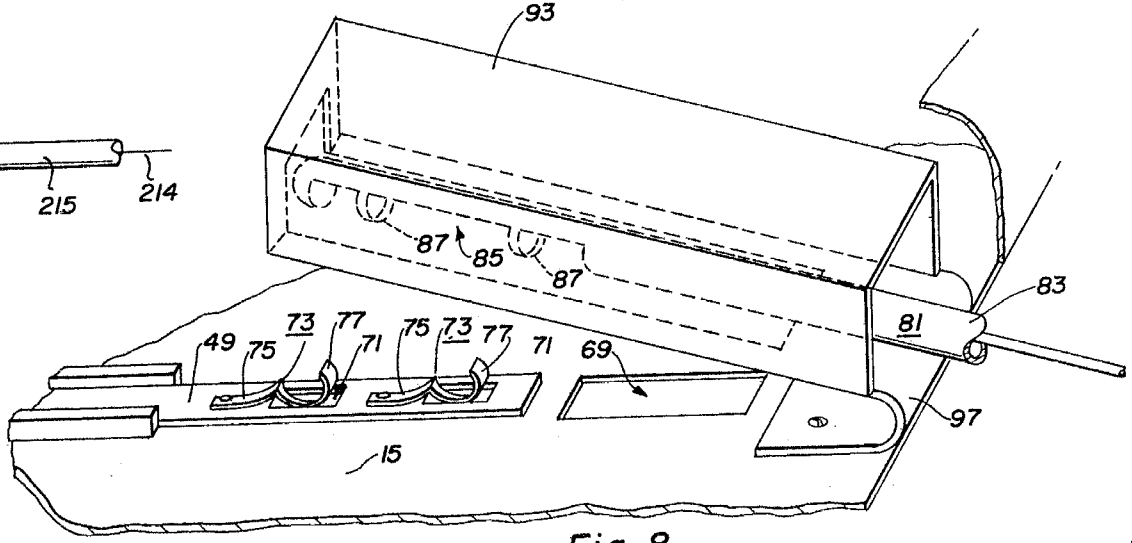
FIG. 8 is a fragmentary view of the central front portion of a seat assembly illustrating a tool for controlling elevation of the seat cushion, and the manner in which it cooperates with the internal mechanism of the seat assembly for each purpose.
Figure 13:
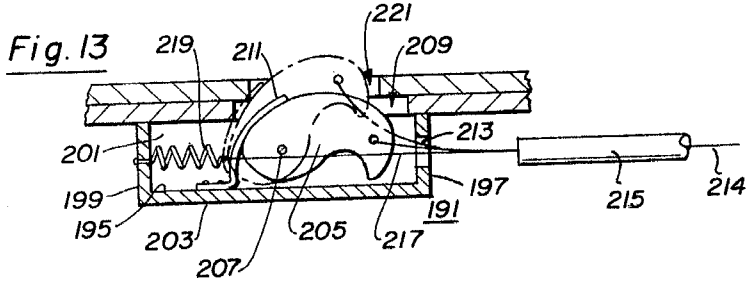
FIG. 13 is an enlarged view, in section, of a latching feature involved in the portion of the control apparatus illustrated in FIG. 12.
Figure 9:
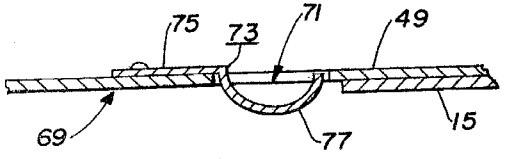
FIG. 9 is a view of a detail of the internal mechanism with which the tool cooperates.

Referring to the drawings for details of my invention in its preferred form, I have illustrated in FIGS. 1 through 3, the character of foldable chair to which the present invention is applicable. Such chair is of foldable type constructed of a leg member 3, a leg and back member 5, a seat component 7 and a backrest component 9. The various members and components are connected together by pivots and slidable elements, not all of which are shown, but which are conventional in the prior art, so that the chairs may be unfolded for use, or may be folded as illustrated in FIG. 4 for compact storage.

The seat component includes a frame 13 having a floor 15, a cushion assembly 17 including a cushion 19 and a cushion support 21 telescoping in said frame to provide for a retractable cushion assembly. The cushion is normally urged to its retracted position into the seat frame by four corner assemblies 23, each located in a different corner of the frame and involving telescoping components 25, 27, one connected to the floor of the frame and the other to the cushion support, and included within each is a tension spring 29 normally urging the telescoping components to their telescoping position to retract the cushion assembly into the frame, but may be releasably latched in expanded condition. These corner assemblies and their manner of control are fully disclosed in detail in my U.S. Pat. No. 3,802,734 of Apr. 9, 1974 for Folding Chair.

Important to the present invention is a novel combination involving means within the chair structure for use in elevating the cushion assembly to its useful position against the retracting force of the corner tension spring assemblies and means, under control of an operator, for effecting operation of the elevating means within the chair after the chair has been unfolded.

The mechanism within the chair for bringing about elevation of the seat cushion assembly comprises spring means 35 between the floor 15 of the frame and the cushion support 21, the spring means normally being in a lowered position when the cushion assembly is in its retracted state, and means 39 for use in elevating the spring means against the cushion support, to elevate the cushion assembly from its retracted position.

The spring means comprises a plurality of resilient arms 41 interconnected at one end adjacent the rear of the frame, where they are secured to a plate 43 slidably anchored to the floor of the seat frame for movement toward the front of the frame. The number of resilient arms should be such as to occupy substantially the width of the seat, and each arm preferably terminates in an upper branch 45 and lower branch 47.

The spring means supporting plate 43 is connected to the rear end of a slide bar 49 resting on the floor of the frame for sliding movement toward the front of the frame, in which movement, the slide bar is controlled by guide ribs 53 affixed to the floor of the frame to either side of the slide bar. Thus, as the slide bar moves toward the front of the frame, it will pull the spring means along with it.

As the spring means moves in the frontal direction, the various spring arms and included branches are caused to elevate during which, the upper branches are brought into engagement with the cushion support to elevate the cushion assembly from its retracted position within the frame, to an elevated position where the cushion is ready for use.

To assure such elevation of the spring arms, a pair of the intermediate spring arms are each connected by a supporting link 59 which, at its other end is pivotally secured to a fixed location on the floor of the frame, a short distance to the front of the connection of the link to the proximate spring arm, whereby upon forward travel of the spring arm, the links will rotate from a reclining position to a vertical position, in the course of which, the spring arms will be elevated, and, with the links of proper length, the height to which the free ends of the upper branches 45 may rise, can be sufficient to engage the cushion support and elevate the same sufficiently to expose the cushion for use.

Where the upper branches of the spring arms ultimately come to rest against the cushion support, the cushion support may be provided with an abutment 63, the engaged surface being preferably somewhat concave to stabilize the functional position of the spring means.

To stiffen the spring means and render added support to an individual sitting on the cushion, the lower branch 47 of each spring arm may be brought to rest under compression, upon a protuberance 65 arising from the floor of the frame.

To provide for forward movement of the slide bar in order to bring about elevation of the cushion assembly from its retracted position within the seat frame, the floor of the seat frame adjacent the front wall and in line with the slide bar, has an elongated opening 69 over which the slide bar will move when urged forward.

The slide bar at its forward end, is provided with at least one opening 71 therethrough and, preferably, a pair of such openings, each adapted to register with the floor openings 69 as the slide bar is moved toward iits forward position.

A hook 73 is provided for each opening in the slide bar, such hook having a spring shank 75 by which it is anchored to the slide bar with the hook portion 77 normally urged by the shank into its associated opening in the slide bar, and into the floor opening when the two openings are registering, to thereby substantially submerge the hook below the upper surface of the slide bar.

Subsequently, as the slide bar is returned toward the rear, to bring the openings out of registry, the hook will rise to slide along the floor of the frame, such rise causing a substantial portion of the hook to emerge from its opening, where it may be engaged by a suitable tool 81 to drag the slide bar to its forward position until the hook openings again register with the floor opening and disengage themselves from the tool, at which stage, the spring means will have been elevated to urge the cushion out of the frame to its position for use.

The tool may take the form of a solid rod having a notch therein for each hook provided on the slide bar and spaced accordingly, but I prefer a hollow rod 83 having a longitudinal slot 85 along the bottom half to permit of the insertion and fixation as by welding, of a transverse partition 87 for each hook provided on the slide bar and spaced accordingly, whereby the partitions may be relied on to engage the slide bar hooks for urging the slide bar to its forward position.

Such tool may gain access to the interior of the frame for this purpose, through an opening 91 in the front wall of the frame in line with the slide bar, and, to facilitate its engagement with the hooks, a section of tubing 93 preferably rectangular in cross-section and having a longitudinal portion of its floor removed, is hingedly secured by a spring hinge 97 to the floor of the frame, adjacent the opening in the front wall. Preferably, the spring hinge should support the tubular section at a slight incline.

Such tubular section 93 will act as a guide when inserting the tool through the front wall opening of the frame, and then by bearing down slightly on the tool, the guide can be lowered sufficiently to enable the tool to engage the hooks for drawing the slide bar toward the front of the frame.

While the tool may be manually retracted, one of the aims of the present invention provides for mechanical actuation of the tool, whereby a large number of chairs arranged in rows may have their cushions elevated for use in short order.

Toward this end, I provide a stand 101 on wheels adapted to be moved quickly between rows of unfolded chairs, and on such stand, is supported apparatus 103 for effecting a rapid withdrawal of the tool following engagement thereof with the hooks within the frame of the chair, to thereby elevate the cushion of such chair.

A bracket 105 mounted on and extending upward from the stand, supports an electric motor 107 having a shaft 109 extending downwardly through a bearing 111 to drive a toothed pulley 113 located to one side of the bracket. This pulley in turn is belt-connected to a toothed pulley 115 of larger diameter, supported from the upper platform of the stand and carries on its upper surface, a cam 117. The pulley drive and cam are enclosed within a housing 119 on the upper platform of the stand.

Slidably supported by the upper surface of the housing is a carrier 125 having a shaft 127 extending downwardly through a slot in the housing and carrying a roller 129 in the plane of the cam. The carrier is attached to one end of a pressure spring 131, the other end of which is connected to the bracket 105 which supports the motor, and is of sufficient length to urge the roller into continuous engagement with the edge of the cam. Thus as the cam rotates, the carrier will move toward and away from the bracket in accordance with movement of the cam.

Fixedly mounted on the upper surface of the housing in spaced relationship to that side of the carrier opposite the spring, is a fulcrum 135 to which is pivotably secured a lever 137 at a intermediate point on the lever.

The lower end of the lever is flexibly coupled to the carrier 125 whereby the lever will rock in response to cam movements of the associated roller. The lever can thus be employed to effect a tugging movement of the tool in effecting forward movement of the slide bar, with resulting elevation of the seat cushion to its useful position.

To effect this, I provide a flexible arm 138 anchored at one end to the pulley-cam housing 119 and connected at its other end to the tool 81, and a cable 140 connected at one end to the upper end of the lever, passes through this flexible arm and openings 131 in the tool partitions, to the tip of the tool, where it is anchored as by welding or otherwise.

For performing its desired functions, this flexible arm is sectionalized, one end section 141, at the anchored end of the flexible arm, involving a pair of telescoping cylinders, an outer cylinder 142 and inner cylinder 143, while the end section 144 at the tool end also involves a pair of telescoping cylinders, an outer cylinder 145 and inner cylinder 146, the two end sections being coupled by an intermediate section 151 comprising a flexible sleeve 153 of rubber or plastic, in which are housed a series of balls 155 of similar material, each, except probably for the last ball in the series, having a concave recess 157 to receive the adjacent ball and provide a bearing surface therefor.

The front end of the sleeve 153 is preferably turned in and attached to a washer 159 which functions as a partition between the central or intermediate section 151 and the end section 144 which carries the tool and functions as the handle.

This latter section, as previously indicated, comprises a pair of tubular elements, the one 145 of larger diameter, housing a plug 161 at that end adjacent the central section, the plug being tapered to enable turning in the edge of the cylinder element for attachment to the washer 159.

The inner cylindrical element 146 slides within the element of larger diameter, and, at its free end, the tool is attached as by soldering or welding. Within the cylindrical element of smaller diameter is a plug 163 adjacent the tool end, and a coil spring 165 housed within the telescoping elements and bearing against the end plugs, normally tend to urge the telescoping elements to their expanded positions.

The section of the flexible arm adjacent the motor, as previously indicated comprises a pair of telescoping elements, the one of larger diameter being affixed at one end to the pulley-cam housing, at which end, it carries a plug 169, the element of smaller diameter being slidably inserted at one end into the element of larger diameter, while at its other end, it is maintained in fixed relationship to the proximate end of the central section by a hose clamp 171 or the like surrounding the proximate ends and clamping the same to an internal partition 173 of adequate thickness.

At an intermediate location within the element 139 of small diameter, there is installed a fixed partition 175 to provide an anchor for one end of a tension spring 177 within the section, while the other end of the spring is anchored to the plug 169. Thus the spring will normally tend to urge the two tubular elements of this section into maximum permissible telescoping relationship.

The cable 140 which actuates the tool from the lever 137, enters the flexible arm through a slot 181 in the tubular element 143 and runs axially through the remainder of the flexible arm to tip of the tool, the various components of the flexible arm being provided with openings for the purpose.

The flexible arm as thus described, enables one to grasp the same at the cylinder 145 as a handle and then stretch the arm to permit of insertion of the tool through the front opening of the seat frame to grasp the hooks on the slide bar. Such stretching will normally necessitate an expansion of not only that end section which carries the tool, but that end section in proximity to the motor.

Further, upon stretching or elongation of the flexible arm, in the process of insertion of the tool as indicated, tension will be placed on the cable sufficient to rotate the lever from its normally spring lowered position, to an upright position.

Thereafter upon energization of the motor, sufficient to rotate the cam 117 and urge the roller to its position of maximum spring compression, the lever will be retracted to its normally low position, in the course of which the tool will be pulled forward, as a result of which, the springs within the chair seat will be elevated to bring the seat cushion to its usable position from within the seat frame.

Such momentary energization of the motor may be accomplished by running the motor circuit through a push button 185 mounted at the tip of the handle.

A tube 187 pivotally mounted at one end to the upper side of the cylinder 142 provides for passage of the cable 140 therethrough, and with the cable thus running through the tube, the tube will function to take up slack which would otherwise occur in the cable during operation of the apparatus.

During retraction of the tool, the flexible arm will, in the absence of precautions, be restored to its previous condition. In the course of servicing a large number of seats in a row, however, this would require repeated stretching of the section nearest the motor, since the function of this section is to permit elongation of the arm sufficiently to facilitate handling of the tool. Thus, it would be a convenience if this section could be maintained in its expanded condition while the seats were being serviced, and then upon completion of the servicing operation, permit of this section to telescope so that, when the apparatus is not in use, the arm will have been restored to its shortest length.

With this in mind, a latch and release mechanism 191 is installed adjacent the free end of the tubular element 142, to be controlled by a finger operable trigger 193 affixed to the side of the handle.

The catch and release mechanism comprises a housing 195 having a front and rear end wall, 197, 199 respectively, side walls 201 and a floor 203, and within such housing is a latch 205 pivotally mounted on a cross-pin 207 supported between the side walls, the latch being substantially goose-necked in contour and of a length adapted to be rotated through a slot 209 provided in the tubular member 142 to which it is affixed. The latch is normally urged to this upright position by a leaf spring 211 affixed thereto and anchored to the floor of the housing.

The latch is connected by one strand 213 of a two strand cable 214 passing through a tubular sheath 215 to the trigger 193 on the handle of the flexible arm. The other strand 217 of the cable is connected to one end of a tension spring 219 located within the housing and connected at its other end to the rear end wall of the housing.

The telescoping element 143 associated with the latch and release mechanism, is provided with a slot 221 adapted to register with the slot 209 in the associated element 142 to which the latch and release mechanism is attached, so that as the flexible arm is extended from its retracted position to its elongated condition, the aforementioned slots will register and permit the latch spring to rotate the latch to its upward position, in which position, it will latch the telescoping element 143 and retain it in its extended position.

In its aforementioned latching position, the trigger cable 214 should be rather taught with the tension spring 219 in the housing extended. This portion of the arm, therefore, will remain extended to facilitate servicing of the rows of chairs.

Upon completion of the job, the operator by manipulating the trigger on the handle, can retract the latch within its housing and permit telescoping of the proximate section 141 of the arm, while the tension spring within the latch housing will take up any resulting slack in the trigger cable.

Auxiliary springs may be desirable in some chairs, to lend support to the cushion, along the front portion of the seat. In such event, an additional slide bar 225 may be provided one to either side of the central slide bar and in spaced parallel relationship thereto. A connecting bar 227 rigidly connecting each to the central slide bar, will cause these additional slide bars to move with the central slide bar.

Straddling each slide bar, including the central bar, is a pivot bracket 229 having upstanding arms 231, each terminating in an offset end 233 which carries an inwardly directed pivot 235.

Rotatable supported by these pivots is a spring assembly involving an arch 237 terminating in end legs 239, each supported on a spring 241 housing in a cylinder 243. The pivots, each engage the proximate cylinder at an intermediate point, which permits the spring assembly to assume a down position approaching the horizontal, with the arch contacting the slide bar. A notch 245 in the center of the arch permits of a closer approach to a horizontal position.

From a location on each cylinder, above the pivot point contact, a rod 247 extends toward the front for attachment to the slide bar. Forward movement of the slide will thus cause the rods 247 to rotate the associated spring assembly to a vertical position for engagement with the seat cushion to assist in elevating the same.

Since, during such rotation, the cylinders 243 will, in the absence of provisions, abut against the bottom of the seat, slots 249 in the seat bottom, in the path of movement of the cylinders, will avoid such abutment.

In the event the chairs being serviced, have retractable back cushions, which should be elevated when put to use, the back assembly may be constructed similarly to that of the seat, though lighter weight components may be utilized, as they would not have to sustain the same weight as the seats. Such mechanism by reason of its lighter construction, may readily be controlled manually by means of an external tug lever mounted on the bottom of the backrest frame and mechanically coupled to the corresponding slide bar.

As an alternative, the corresponding slide bar of the back frame may be coupled to the slide bar within the seat frame by appropriate cables, whereby operation of the seat mechanism will simultaneously control operation of the corresponding mechanism in the back frame, and such cable coupling becomes quite feasible where the foldable chairs are of tubular construction.

In such case, the slide bar of the seat is connected to the corresponding slide bar of the back rest by a pair of cables 255, 257, each, at one end, connecting to an intermediate point on the seat slide bar and passing out of the seat through an opening in the side of the seat frame, into a different one of the proximate tubular member 5 of the chair frame, then out of the tubular member, at a location opposite the back rest frame, then through an opening in the proximate side of the back rest frame to be connected to an intermediate point on the slide bar of the back rest.

Thus, as the slide bar in the seat is urged forward by the tool to elevate the seat cushion, the cables will cause a corresponding movement of the slide bar in the back rest to elevate the back rest cushion in like manner.

To maintain tension in these cables under these conditions, means are provided for latching the slide bar of the back rest, when in its forward position.

Toward this end, the slide bar, at its forward end, is preferably of increased thickness to permit of forming a recess 267 therein, without weakening the bar at this point.

At its most forward position, this recessed end of the slide bar is adapted to be engaged by a latch spring 269 affixed to the lower end of an upward directed pin 271, slidably guided in an appropriate sleeve 273 which is fixed to the floor of a recessed portion 277 of the back rest, located centrally of the lower or front edge of the frame portion.

The pin 271, at its upper end is hingedly attached to an intermediate point of a lever 281 lying in said recessed portion and hingedly anchored at one end to the floor of said recessed portion.

By lifting up on the free end of said lever, the latch pin may be raised to lift the spring from latching engagement with the slide bar, to permit release thereof as a preliminary step forward retracting the cushions. To facilitate lifting of the lever, a flexible tab of plastic 283 or the like is attached thereto.

The mechanism for retracting the cushions is fully disclosed in my prior patent, previously referred and is not part of the present invention.

From the foregoing description of my invention in its preferred form, it will be appreciated that the same fulfills all the objects attributable thereto, and while I have illustrated and described the same in great detail, the same is subject to alteration and modification without departing from the scope of the invention as defined by the appended claims.

I claim:

1. In combination, a folding chair including a seat comprising a frame having a floor, a cushion assembly including a cushion and cushion support telescoping with said frame to provide for a retractable cushion assembly, means normally urging said cushion assembly to its retracted position with respect to said seat frame, spring means between the floor of said frame and said cushion support and in a lowered position when said cushion assembly is in its retracted position, and means for elevating said spring means against said cushion support to elevate said cushion assembly from its retracted position, said means for elevating said spring means including a slide bar resting on the floor of said frame and directed toward the front of said frame, means for guiding movement of said slide bar toward and away from the front of said frame, a support for said spring means, said support being connected to that end of said slide bar facing toward the rear of said frame and adapted to move with said slide bar, means for anchoring said spring means to said spring means support, whereby said spring means will move with said slide bar and support, and means responsive to movement of said slide bar toward the front of said frame for raising said spring means into pressure engagement with said cushion support to elevate said cushion to its normally usable position.

2. A combination in accordance with claim 1, characterized by means anchoring said spring means at one end to said spring means support, said spring means being of a length reaching approximately to the center of said frame, and further characterized by said means for raising said spring means including a link, means pivotally securing said link at one end to a fixed location in proximity to said slide bar and means at the opposite end of said link for pivotally anchoring said spring means to said link, whereby, movement of said spring means in the direction toward the front of said frame, will pivot said link about its fixed end and raise said spring means into pressure engagement with the cushion support of said cushion assembly, to elevate said cushion to its normally usable position.

3. A combination in accordance with claim 1, characterized by means for moving said slide bar toward the front of said frame, said means including said frame floor having an opening adjacent the front of said frame, said slide bar having an opening adapted to register with said floor opening when said slide bar is moved toward the front of said frame, a hook having a shank, means anchoring said hook by its shank to said slide bar with said hook normally urged into said slide bar and floor openings when such openings are in alignment, whereby, in the absence of such alignment, the floor of said frame will raise said hook to expose the same above said slide bar.

4. A combination in accordance with claim 3, characterized by said means for moving said slide bar toward the front of said frame further including said frame having a front opening in line with said slide bar, a guide channel resiliently anchored at one end adjacent said opening and extending inwardly of said frame above said slide bar and having an elongated opening in the bottom thereof facing said slide bar, and a tool adapted to enter said channel through said front opening, said tool including means for engaging said hook upon depressing said channel with said tool inserted therein, whereby, upon withdrawal of said tool, said slide bar will be dragged forward until said slide bar opening arrives in alignment with said floor opening and the hook will automatically drop out of engagement with said tool.

5. A combination in accordance with claim 4, characterized by said tool having means associated therewith for mechanically withdrawing said tool at the will of an operator, after engagement of said tool with said slide bar hook.

6. A combination in accordance with claim 5, characterized by said means for mechanically withdrawing said tool at the will of an operator, including a stand adapted for movement between rows of such chairs, a flexible arm having one end attached to said stand with said tool attached to the other end, said flexible arms having a contractable section, a cable carried within said flexible arm and connected at one end to said tool, a motor carried by said stand, and means responsive to energization of said motor for pulling on said cable to withdraw said tool to actuate the slide bar in said seat with resulting elevation of said cushion assembly.

7. A combination in accordance with claim 1, characterized by said chair having a back rest with a retractable cushion assembly and a slide bar and spring means comparable to that of said seat, and means interconnecting the slide bar of said seat to the slide bar of said back rest, whereby, upon actuation of said seat slide bar, both said seat cushion assembly and said back rest cushion assembly will be elevated from their retracted positions.

8. For use in elevating the retracted cushion assembly of a chair seat involving a frame having a floor, a cushion assembly including a cushion and cushion seat telescoping with such frame to provide for such retractable cushion assembly, means for normally urging such cushion assembly to its retracted position with respect to such seat frame, and means including a slide bar for elevating the cushion assembly; a tool assembly for actuating such slide bar, said tool assembly comprising a tool adapted to engage such slide bar within such seat, and means for withdrawing said tool at the will of an operator, said means including a stand adapted for movement between rows of such chairs, a flexible arm having one end attached to said stand with said tool attached to the other end, said flexible arm having a contractable section, a cable carried within said flexible arm and connected at one end to said tool, a motor carried by said stand, and means responsive to energization of said motor for pulling on said cable to withdraw said tool while in engagement with such slide bar.

9. A tool assembly in accordance with claim 8, characterized by said means responsive to energization of said motor for pulling on said cable, including a lever pivotally mounted at an intermediate point thereof with one end connected to the other end of said cable, and cam means for swinging said lever from a position determined by engagement of said tool with such slide bar to a position determining a withdrawal of said tool from engagement with such slide bar, and means drive coupling said cam means to said motor.

* * * * *